US011822363B2

(12) United States Patent
Uchida et al.

(10) Patent No.: US 11,822,363 B2
(45) Date of Patent: Nov. 21, 2023

(54) OPERATION DEVICE

(71) Applicant: ALPS ALPINE CO., LTD., Tokyo (JP)

(72) Inventors: Ryosuke Uchida, Miyagi (JP); Norimasa Okanishi, Miyagi (JP); Hisato Shimomura, Miyagi (JP); Masahiro Asano, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 83 days.

(21) Appl. No.: 17/651,262

(22) Filed: Feb. 16, 2022

(65) Prior Publication Data

US 2022/0171423 A1 Jun. 2, 2022

Related U.S. Application Data

(63) Continuation of application No. PCT/JP2020/011504, filed on Mar. 16, 2020.

(30) Foreign Application Priority Data

Aug. 30, 2019 (JP) ..... 2019-158904

(51) Int. Cl.
*G05G 9/047* (2006.01)
*G05G 1/04* (2006.01)

(52) U.S. Cl.
CPC ..... *G05G 9/047* (2013.01); *G05G 1/04* (2013.01); *G05G 2009/04722* (2013.01)

(58) Field of Classification Search
CPC ..... G05G 9/047; G05G 1/04; G05G 2009/04722; G05G 2009/04714; H01H 25/04; H01H 25/06
See application file for complete search history.

(56) References Cited

U.S. PATENT DOCUMENTS 6,029,537 A * 2/2000 Nagao ..... G05G 9/047 74/471 XY
6,328,127 B1 * 12/2001 Hori ..... G05G 9/047 74/471 XY (Continued)

FOREIGN PATENT DOCUMENTS

EP 2113819 A2 * 11/2009 ..... G05G 25/02
JP 2007-059161 3/2007

(Continued)

OTHER PUBLICATIONS

International Search Report for PCT/JP2020/011504 dated May 26, 2020.

*Primary Examiner* — Vinh T Lam
(74) *Attorney, Agent, or Firm* — IPUSA, PLLC

(57) ABSTRACT

An operation device includes a housing provided with a through hole; a cylinder-shaped lever inserted into the housing through the through hole of the housing, that can be operated to be tilted; an actuator contained in a cylinder-shaped opening of the lever; and an elastic member provided between the actuator and the lever. A step is provided in the opening of the lever on one side of the elastic member. A step is provided in the actuator on another side of the elastic member. A surface of the step of the actuator is inclined with respect to a surface of the step in the opening of the lever.

7 Claims, 12 Drawing Sheets

110

(56) References Cited

U.S. PATENT DOCUMENTS 6,429,849 B1 * 8/2002 An ..... G05G 25/04 345/161
6,461,242 B2 * 10/2002 Takeda ..... A63F 13/95 345/161
6,642,824 B2 * 11/2003 Oomkes ..... G01D 5/145 335/207
6,787,716 B1 * 9/2004 Menche ..... H01H 11/0006 200/6 A
7,265,304 B2 * 9/2007 Ichiki ..... F15B 13/0424 200/6 A
7,320,263 B2 * 1/2008 Gustafsson ..... G05G 5/28 74/471 XY
7,476,822 B2 * 1/2009 Miura ..... H01H 19/11 200/336
7,507,919 B2 * 3/2009 Sugahara ..... H01H 25/06 200/6 A
7,821,496 B2 * 10/2010 Rosenberg ..... G06F 3/038 345/161
8,035,043 B2 * 10/2011 Asada ..... H01H 25/06 200/6 A
8,039,767 B2 * 10/2011 Saomoto ..... G05G 9/047 200/18
8,084,703 B2 * 12/2011 Hisamune ..... H01H 19/14 200/336
8,186,240 B2 * 5/2012 Sakai ..... A43B 21/42 345/161
8,263,882 B2 * 9/2012 Laurent ..... G05G 9/04796 200/6 A
8,344,914 B2 * 1/2013 Yeh ..... G06F 3/0338 341/20
8,400,333 B2 * 3/2013 Ishikawa ..... G05G 25/02 341/35
8,957,331 B2 * 2/2015 Matsumoto ..... H01H 25/065 200/4
9,052,736 B2 * 6/2015 Kreider ..... H01H 25/065
9,536,689 B2 * 1/2017 Noh ..... H01H 25/04
10,522,308 B2 * 12/2019 Noh ..... G05G 9/04792
10,724,205 B2 * 7/2020 Nadaoka ..... E02F 3/3672
10,935,126 B2 * 3/2021 Asahina ..... F16H 59/105
11,029,137 B2 * 6/2021 Boerman ..... F16B 2/10
11,519,158 B2 * 12/2022 Morimoto ..... E02F 9/20
2005/0162383 A1 * 7/2005 Rosenberg ..... A63F 13/24 345/156

FOREIGN PATENT DOCUMENTS

JP 2007059161 A * 3/2007
JP 2014-116084 6/2014
JP 2014116084 A * 6/2014
JP 5956917 B2 * 7/2016

* cited by examiner

OPERATION DEVICE

CROSS-REFERENCE TO RELATED APPLICATION

The present U.S. non-provisional application is a continuation application of and claims the benefit of priority under 35 U.S.C. § 365(c) from PCT International Application PCT/JP2020/011504 filed on Mar. 16, 2020, which is designated the U.S., and is based upon and claims the benefit of priority of Japanese Patent Application No. 2019-158904 filed on Aug. 30, 2019, the entire contents of which are incorporated herein by reference.

BACKGROUND OF THE INVENTION

1. Field of the Invention

The present disclosure relates to an operation device.

2. Description of the Related Art

In recent years, as the controller of a game console or the like, an operation device through which operational information can be input by tilting a lever such as a joystick or the like, is used. With such an operation device, an operation of pushing down the lever can be performed, in addition to an operation of tilting the lever in two-dimensional directions. See, for example, Japanese Laid-Open Patent Application No. 2014-116084.

In the meantime, in the case of playing a game using the controller of a game console or the like, operations of tilting the lever are frequently performed; here, a slight gap is generated between the lever and an actuator provided inside the lever due to manufacturing tolerances and the like. Such a gap may cause looseness (or rattle) to be felt when operating the lever, or may make a play (or freedom of movement) greater. If such looseness and play when operating the lever become greater, when inputting desired operational information, the operator may not be able to input the operational information quickly and accurately. Note that after a long-term use, the gap may be further widened between the lever and an actuator provided inside the lever, due to frictional wear.

Therefore, an operation device has been desired, with which the looseness and the play is less likely to be felt when the lever is being operated, and generates no delay upon inputting operational information by an operation of the lever.

SUMMARY OF THE INVENTION

According to the one aspect in the present disclosure, an operation device includes a housing provided with a through hole; a cylinder-shaped lever inserted into the housing through the through hole of the housing, that can be operated to be tilted; an actuator contained in a cylinder-shaped opening of the lever; and an elastic member provided between the actuator and the lever. A step is provided in the opening of the lever on one side of the elastic member. A step is provided in the actuator on another side of the elastic member. A surface of the step of the actuator is inclined with respect to a surface of the step in the opening of the lever.

DESCRIPTION OF THE PREFERRED EMBODIMENTS

Figure 1:
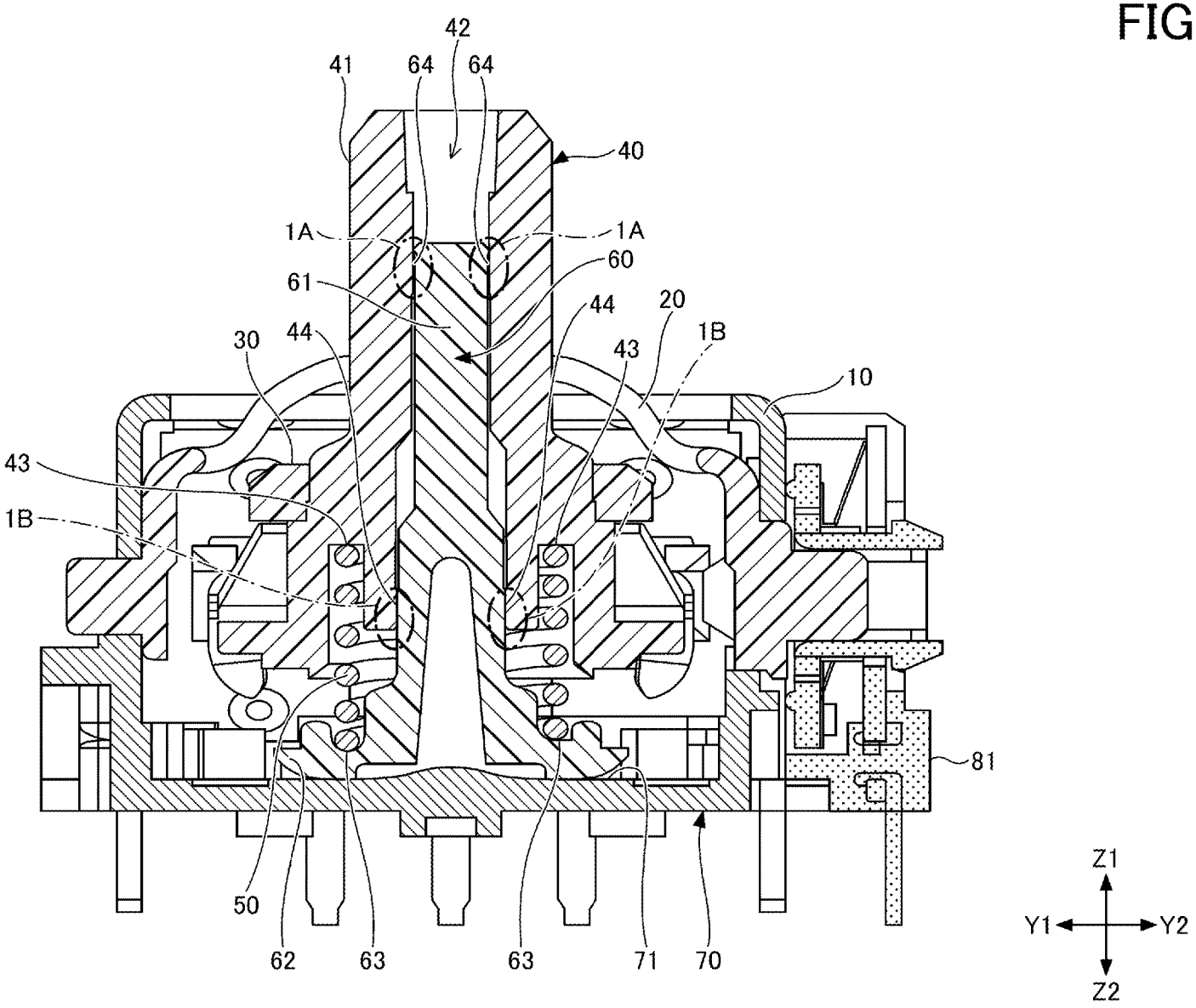
FIG. 1 is a cross-sectional view of an operation device.

In the following, embodiments of the present inventive concept will be described with reference to the drawings.

According to the disclosed operation device, generation of a delay and inaccuracy upon inputting operational information by an operation of the lever can be suppressed. Note that the same numerical codes are assigned to the same members throughout the drawings, and their duplicate descriptions may be omitted. Note that in the present application, an X1-X2 direction, a Y1-Y2 direction, a Z1-Z2 directions are assumed to be directions orthogonal to one another. Also, a plane including the X1-X2 direction and the Y1-Y2 direction will be referred to as the XY plane; a plane including the Y1-Y2 direction and the Z1-Z2 direction will be referred to as the YZ plane; and a plane including the Z1-Z2 direction and the X1-X2 direction will be referred to as the ZX plane.

First Embodiment

First, an operation device used as the controller of a game console or the like will be described. This operation device is also called a joystick or the like, through which the operator can input information on the operational direction by tilting the lever.

The operation device will be specifically described with reference to FIG. 1. An operation device illustrated in FIG. 1 includes an upper case 10, a first actuator 20, a second actuator 30, a lever 40, a coil spring 50, a third actuator 60, a lower case 70, a first rotational variable resistor 81, and the like.

This operation device allows the operator to input operational information, by manually operating an operational part 41 in the Z1 direction of the lever 40. The lever 40 is famed to have a cylindrical shape, and an internal opening 42 contains a shaft portion 61 of the third actuator 60.

On this operation device, an operation of tilting the operational part 41 of the lever 40 can be performed in the Y1-Y2 direction as the left-and-right direction in FIG. 1; in the X1-X2 direction as the vertical direction with respect to the paper; and in all directions between the Y1-Y2 direction and the X1-X2 direction. For example, in the case of operating the operational part 41 of the lever 40 in the vertical direction with respect to the paper, this operation is transmitted to the first actuator 20 that contacts the outside of the lever 40, and the first actuator 20 rotates around a pivot in the Y1-Y2 direction, to rotate the slider of the first rotational variable resistor 81, and to change the resistance value in the first rotational variable resistor 81. In this way, operational information regarding the operational part 41 of the lever 40 being operated in the vertical direction with respect to the paper, can be input.

Also, in the case of operating the operational part 41 of the lever 40 in the left-and-right direction in FIG. 1, namely, in the Y1-Y2 direction, this operation is transmitted to the second actuator 30 that contacts the outside of the lever 40, and the second actuator 30 rotates around a pivot in the X1-X2 direction, to rotate the slider of the second rotational variable resistor (not illustrated), and to change the resistance value in the second rotational variable resistor. In this way, by the lever 40, operational information regarding the operational part 41 of the lever 40 being operated in the left-and-right direction, namely, in the Y1-Y2 direction, can be input.

Further, on this operation device, the operator can perform an operation of pushing the operational part 41 of the lever 40 in the Z2 direction. The shaft portion 61 of the third actuator 60 is contained in the opening 42 of the lever 40, and the bottom surface of a bottom 62 of the third actuator 60 contacts a bottom portion 71 of the lower case 70; therefore, when the operational part 41 of the lever 40 is pushed in the Z2 direction, the lever 40 moves in the Z2 direction so as to approach the bottom surface of the bottom 62 of the third actuator 60. Between a recess 43 of the lever 40 and a recess 63 of the third actuator 60, the coil spring 50 is installed, and when the operational part 41 of the lever 40 is pushed in the Z2 direction, the lever 40 moves in the Z2 direction relative to the third actuator 60; therefore, the coil spring 50 contracts. In this state, once the operator detaches the operational part 41 of the lever 40, the restoring force of the coil spring 50 pushes the lever 40 up in the Z1 direction, to return to the original state.

In the meantime, between the inside of the opening 42 of the lever 40 and the outside of the third actuator 60, a slight gap is generated due to manufacturing tolerances and the like. Specifically, a gap may be generated between the periphery of a top end 64 of the third actuator 60 and the interior of the opening 42 of the lever 40 enclosed by a one dot chain line LA, or between the inside of a lower end 44 of the opening 42 of the lever 40 and the periphery of the third actuator 60 enclosed by a one dot chain line 1B. In the case where such a gap is generated, when performing an operation of tilting the operational part 41 of the lever 40, looseness and play are generated; therefore, a delay is generated upon inputting the operational information.

Also, the lever 40 and the third actuator 60 are formed of a resin material or the like; therefore, after repeating the operation of moving the operational part 41 of the lever 40, the inside of the opening 42 of the lever 40 and the outside of the shaft portion 61 of the third actuator 60 rub against each other to wear out, and the opening 42 of the lever 40 gradually becomes wider, and the shaft portion 61 of the third actuator 60 gradually becomes thinner.

Therefore, after a long-term use of the operation device, the gap gradually become wider between the periphery of s top end 64 of the third actuator 60 and the interior of the opening 42 of the lever 40 enclosed by a one dot chain line LA, or between the inside of a lower end 44 of the opening 42 of the lever 40 and the periphery of the third actuator 60 enclosed by a one dot chain line 1B.

In this way, once the gap in a portion designated with the one dot chain lines 1A and 1B between the opening 42 of the lever 40 and the third actuator 60 becomes greater, when performing an operation of tilting the operational part 41 of the lever 40, the looseness and the play become greater; therefore, information is not input promptly upon operating the operational part 41 of the lever 40, and a delay is generated upon inputting the operational information. Such a delay upon inputting the operational information may lead to a serious problem in a game or the like.

Therefore, an operation device has been desired that does not generate a delay upon inputting the operational information.

(Operation Device)

Figure 2:
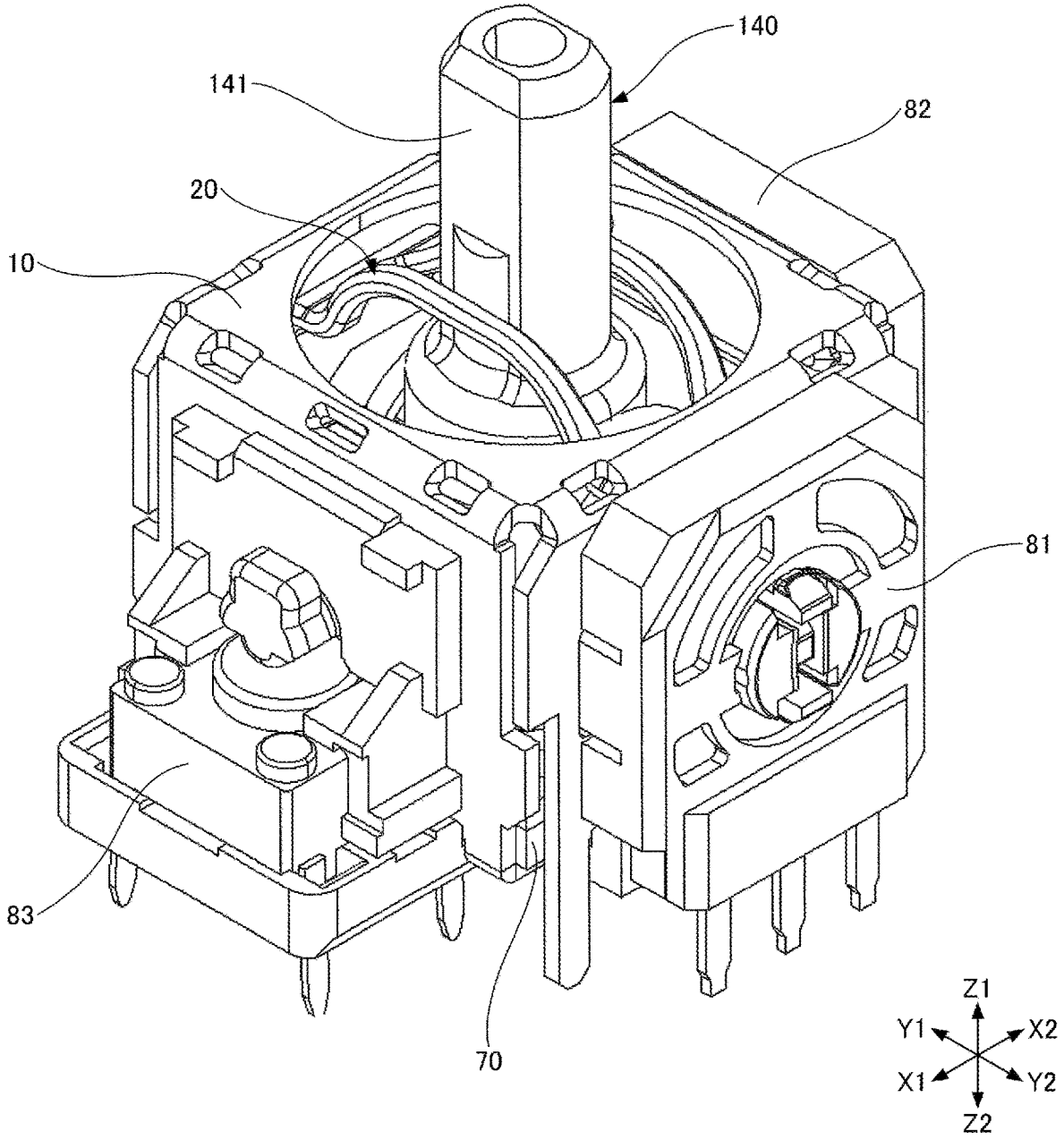
FIG. 2 is a perspective view of an operation device according to a first embodiment.
Figure 3:
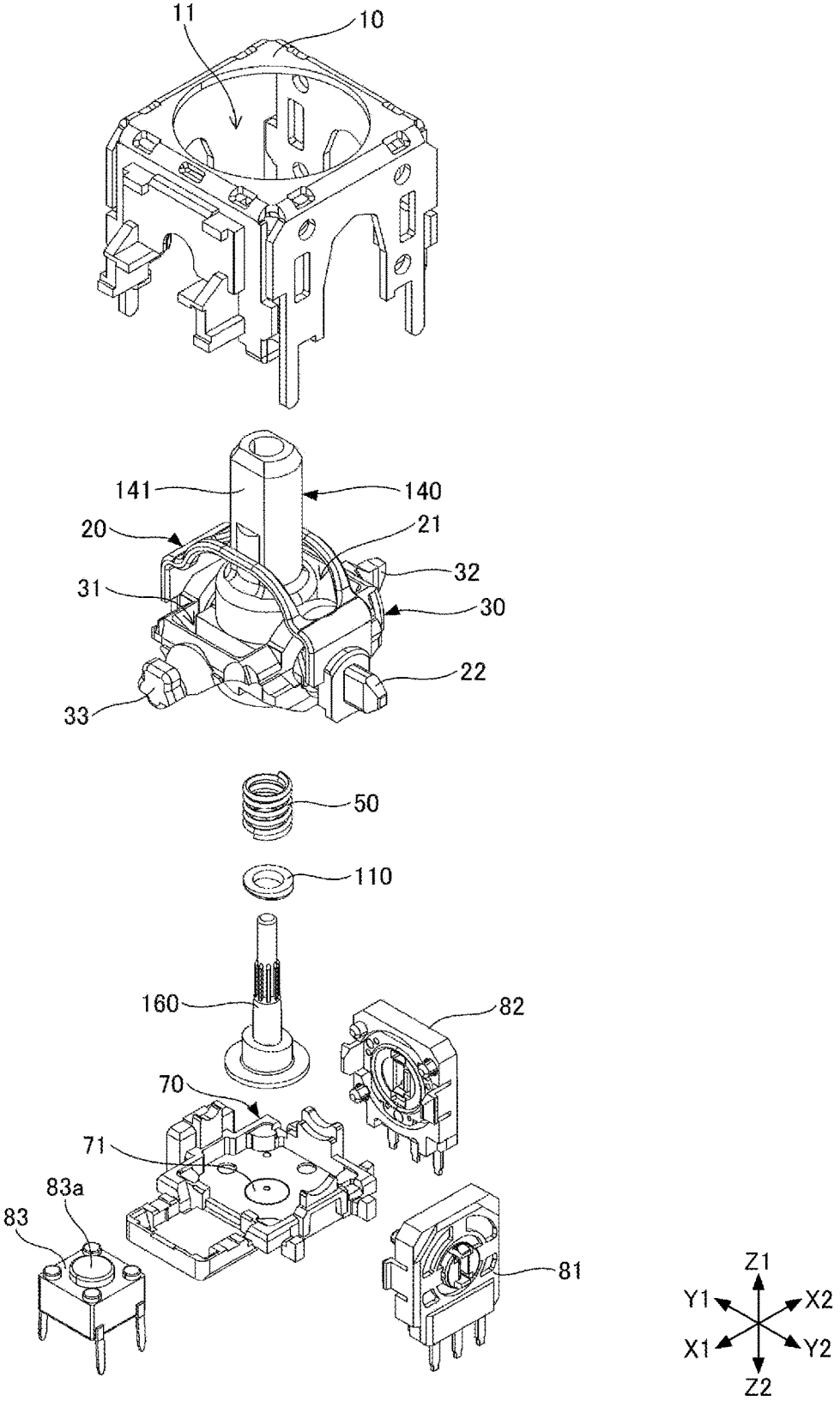
FIG. 3 is an exploded perspective view of the operation device according to the first embodiment.
Figure 4:
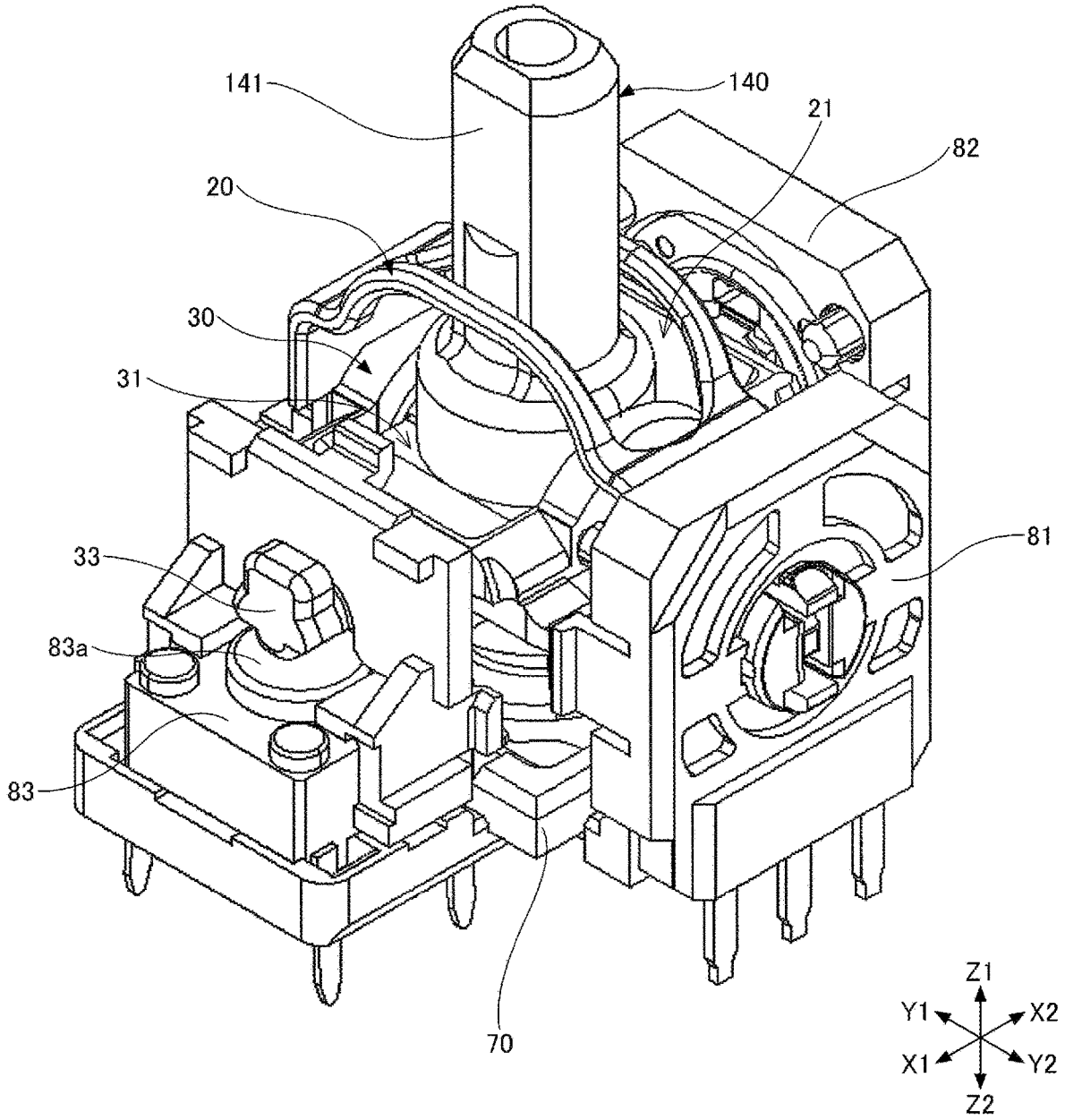
FIG. 4 is a perspective view of the internal structure of the operation device according to the first embodiment.
Figure 5:
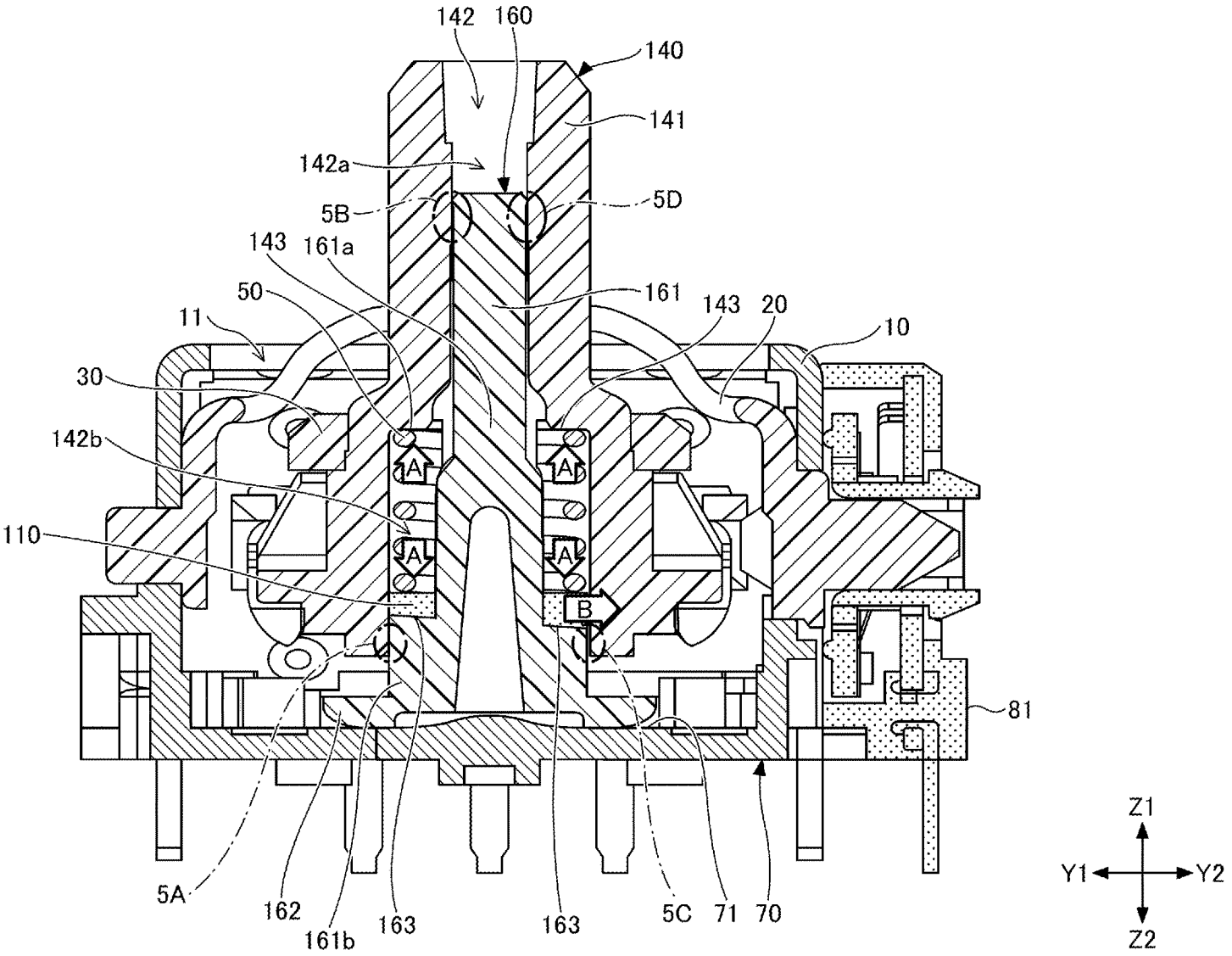
FIG. 5 is a cross-sectional view of the operation device according to the first embodiment.

Next, the operation device according to the first embodiment will be described with reference to FIGS. 2 to 5. The operation device according to the present embodiment can be used as the controller of a home game console, a radio controller, or the like; and upon inputting information by an operation of tilting the lever, the operation device can prevent a delay upon inputting the operational information in an operational direction in which the lever is tilted. Note that FIG. 2 is a perspective view of the operation device according to the present embodiment; FIG. 3 is an exploded perspective view; FIG. 4 is a perspective view of the inside of the operation device in a state of the upper case being removed; and FIG. 5 is a cross-sectional view parallel to the YZ plane.

The operation device according to the present embodiment includes the upper case 10, the first actuator 20, the second actuator 30, the lever 140, the coil spring 50, the spacer 110, the third actuator 160, the lower case 70, the first rotational variable resistor 81, the second rotational variable resistor 82, a push switch 83, and the like. In the present application, the coil spring 50 may be referred to as an elastic member.

The upper case 10 has a through hole 11 in the central portion, and from this through hole 11, an operational part 141 of the lever 140 or the like is inserted, to be protruding out of the upper case 10.

The first actuator 20 is formed to be longer in the Y1-Y2 direction, has a through hole 21 provided in the central portion, and has a structure in which both sides in the X1 direction and in the X2 direction of the through hole 21 contact the lever 140. Also, a shaft portion 22 is famed on the Y2 side of the first actuator 20, and when the first actuator 20 rotates around a pivot in the Y1-Y2 direction by an operation on the operational part 141 of the lever 140, the slider of the first rotational variable resistor 81 rotates via the shaft portion 22, the resistance of the first rotational variable resistor 81 changes, and information regarding the operational part 141 of the lever 140 being tilted in the X1-X2 direction is input.

The second actuator 30 is formed to be longer in the X1-X2 direction, a through hole 31 is provided in the central portion, and has a structure in which both sides in the Y1 direction and in the Y2 direction of the through hole 31 contact the lever 140. Also, in the second actuator 30, a shaft portion 33 on the X1 side and a shaft portion 32 on the X2 side are formed. When the second actuator 30 rotates around a pivot in the X1-X2 direction by an operation on the operational part 141 of the lever 140, the slider of the second rotational variable resistor 82 rotates via the shaft portion 32, the resistance of the second rotational variable resistor 82 changes, and information regarding the operational part 141 of the lever 140 being tilted in the Y1-Y2 direction is input.

Note that the second actuator 30 is attached so as to cover a portion of the lever 140 where the width on the Z2 side is wider, and the lever 140 is contained in the through hole 31 of the second actuator 30 so as to have the operational part 141 protruded to the outside. When the operational part 141 of the lever 140 is tilted on the X1 side or on the X2 side, the lever 140 is movable within the through hole 31 of the second actuator 30.

The first actuator 20 is attached so as to cover the second actuator 30, and the lever 140 is contained in the through hole 21 of the first actuator 20 so as to have the operational part 141 protruded to the outside. When the operational part 141 of the lever 140 is tilted on the Y1 side or on the Y2 side, the lever 140 is movable within the through hole 21 of the first actuator 20.

Therefore, the first actuator 20 is rotatable around the rotating shaft along the Y1-Y2 direction. Also, the second actuator 30 is rotatable around the rotating shaft along the X1-X2 direction.

As illustrated in FIG. 5, the lever 140 is formed to be longer in the Z1-Z2 direction and to have a cylindrical shape, and has the operational part 141 on the Z1 side, and an opening 142 formed to have a cylindrical shape. The width of the opening 142 is formed to be narrower at an upper opening 142*a* on the Z1 side, and to be wider at a lower opening 142*b* on the Z2 side, and between the upper opening 142*a* on the Z1 side and the lower opening 142*b* on the Z2 side at which the width of the opening 142 changes, a step 143 is formed.

Figure 6:
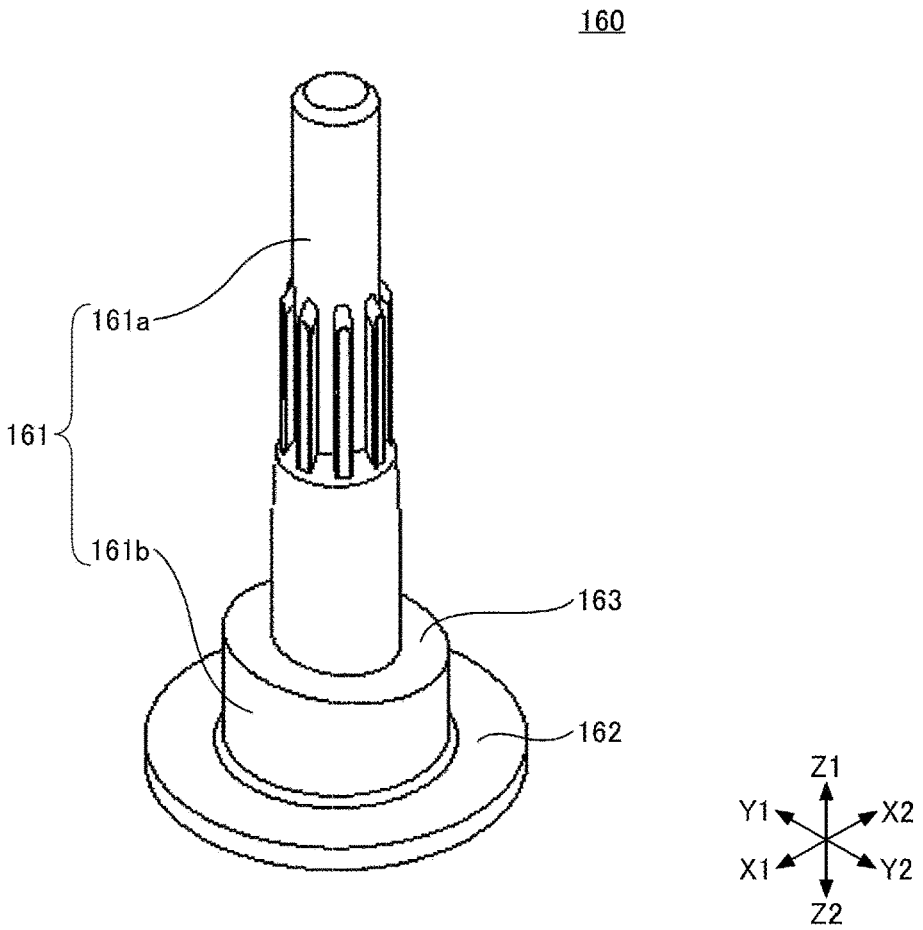
FIG. 6 is a perspective view of a third actuator according to the first embodiment.

As illustrated in FIG. 6, the third actuator 160 is formed to be longer in the Z1-Z2 direction, and has a shaft portion 161 on the Z1 side, and a bottom 162 on the Z2 side that is virtually circular. The shaft portion 161 has a thin shaft portion 161*a* on the Z1 side and a thick shaft portion 161*b* on the Z2 side, and between the thin shaft portion 161*a* and the Z2 thick shaft portion 161*b*, a step 163 is formed. The surface of the step 163 is inclined with respect to the XY plane, and the Y2 side is lower than the Y1 side. The tilt angle of the surface of the step 163 with respect to the XY plane is, for example, 7 degrees.

Figure 7:
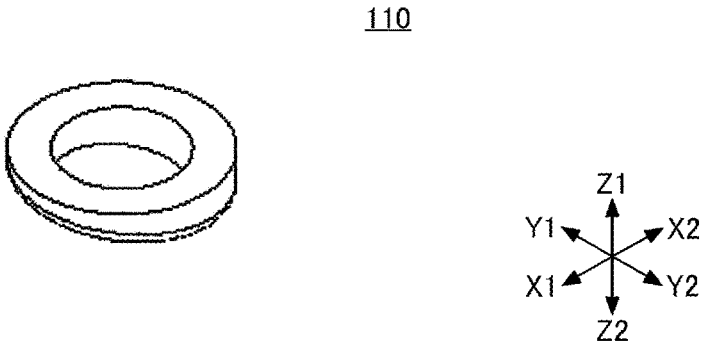
FIG. 7 is a perspective view of a spacer according to the first embodiment.

As illustrated in FIG. 7, the spacer 110 is a ring-shaped member, and is inclined such that the Y2 side is thicker than the Y1 side.

The upper case 10 is provided to cover the first actuator 20, the second actuator 30, the third actuator 160, and a portion of the lever 140 on the Z2 side, which are above the lower case 70, and from the through hole 11 of the upper case 10, the operational part 141 of the lever 140 is exposed.

According to the present embodiment, the upper case 10 and the lower case 70 form the housing of the operation device. By being covered with the upper case 10, the first actuator 20 and the second actuator 30 are locked in a rotatable state.

Also, in the operation device according to the present embodiment, when the lever 140 is pushed in the Z2 direction, the second actuator 30 moves in the Z2 direction together with the lever 140; the shaft portion 33 provided in the second actuator 30 pushes a pushdown part 83*a* of the push switch 83; and thereby, the push switch 83 can be turned on.

In this state, the coil spring 50 contracts in the Z1-Z2 direction, and a restoring force is generated in the coil spring 50, in the direction extending in the Z1-Z2 direction. Therefore, once the operator detaches the lever 140, the force pushing the lever 140 in the Z2 direction disappears; therefore, the restoring force generated in the coil spring 50 pushes the lever 140 up in the Z1 direction, and thereby, the lever 140 can be returned to the original state.

Note that also in the case where the operational part 141 of the lever 140 is tilted in the X1 direction, the X2 direction, the Y1 direction, or the Y2 direction, the coil spring 50 contracts, and hence, by detaching the operational part 141 of the lever 140, the restoring force of the coil spring 50 causes the lever 140 to return to the central position as in the original state.

As illustrated in FIG. 5, the operation device according to the present embodiment has the bottom 162 of the third actuator 160 installed on the bottom portion 71 on the Z1 side of the lower case 70. The shaft portion 161 of the third actuator 160 is contained inside the opening 142 of the lever 140. On the step 163 of the shaft portion 161 of the third actuator 160, the ring-shaped spacer 110 is installed, an end of the coil spring 50 on the Z1 side contacts the step 143 in the opening 142 of the lever 140, and another end on the Z2 side contacts a surface of the spacer 110 on the Z1 side. Therefore, the coil spring 50 is installed between the step 143 of the lever 140 and the spacer 110.

Figure 8:
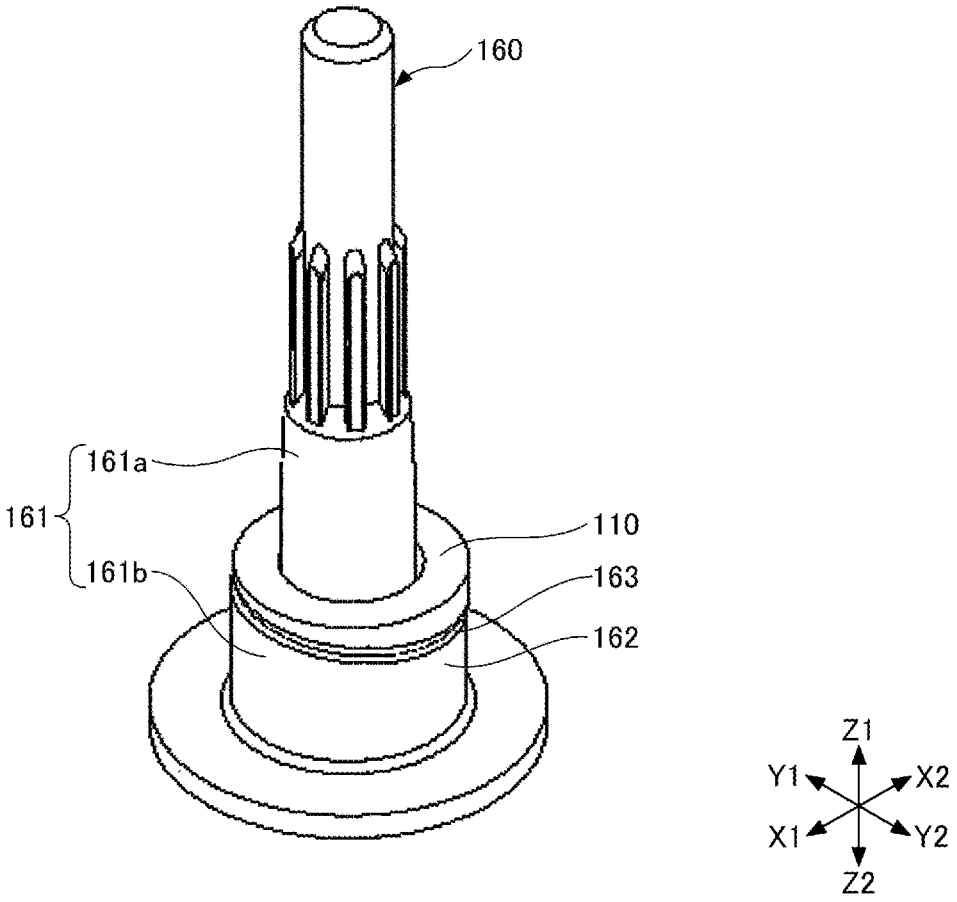
FIG. 8 is explanatory diagram of an operation device according to a second embodiment.

FIG. 8 illustrates a relationship between the third actuator 160 and the spacer 110, in which the spacer 110 is installed on the step 163 between the thin shaft portion 161*a* and the thick shaft portion 161*b* of the third actuator 160. The spacer 110 has a slope corresponding to the slope of the step 163 of the third actuator 160.

As illustrated in FIG. 5, the position of the step 143 in the opening 142 of the lever 140 is formed to be substantially parallel to the XY plane. Also, as illustrated in FIGS. 5 and 8, although the step 163 of the shaft portion 161 of the third actuator 160 is inclined with respect to the XY plane, in a state of the spacer 110 being installed on the step 163, a surface of the spacer 110 on the Z1 side is famed to be substantially parallel to the XY plane.

In the state illustrated in FIG. 5, the coil spring 50 contracts, and as designated with arrows A, a restoring force extending in the Z1-Z2 direction is generated. Therefore, the spacer 110 pushed in the Z2 direction by the coil spring 50 moves to the Y2 side as if sliding on the inclined surface of the step 163. By the end of the spacer 110 on the Y2 side moved in this way, the inside of the end on the Z2 side of the opening 142 of the lever 140 is pushed in the direction designated with an arrow B. This causes, at portions designated with one dot chain lines 5A and 5B on the Y1 side, the opening 142 of the lever 140 to come into contact the shaft portion 161 of the third actuator 160. Therefore, the looseness and the play are almost eliminated, and thereby, the reaction upon operating the operational part 141 of the lever 140 can be accelerated.

Note that at portions designated with one dot chain lines 5C and 5D on the Y2 side, gaps are generated between the opening 142 of the lever 140 and the shaft portion 161 of the third actuator 160. However, thanks to the restoring force by the coil spring 50, on the Y1 side of the shaft portion 161 of the third actuator 160, the state of the opening 142 of the lever 140 contacting the shaft portion 161 of the third actuator 160 is maintained; therefore, even if the operational part 141 of the lever 140 is operated, no delay would be generated in the reaction due to the operation of the operational part 141 of the lever 140.

Second Embodiment

Figure 9:
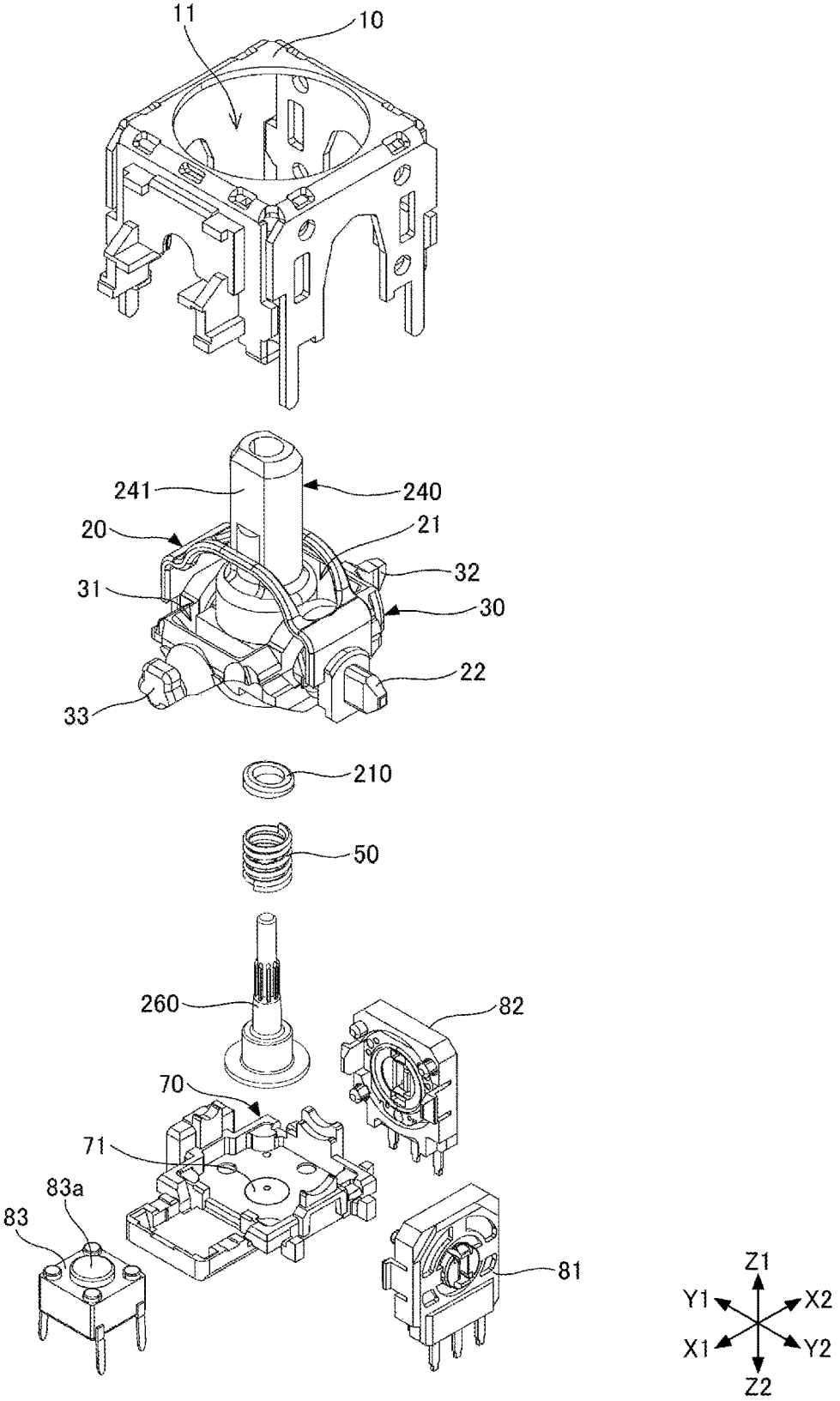
FIG. 9 is an exploded perspective view of the operation device according to the second embodiment.
Figure 10:
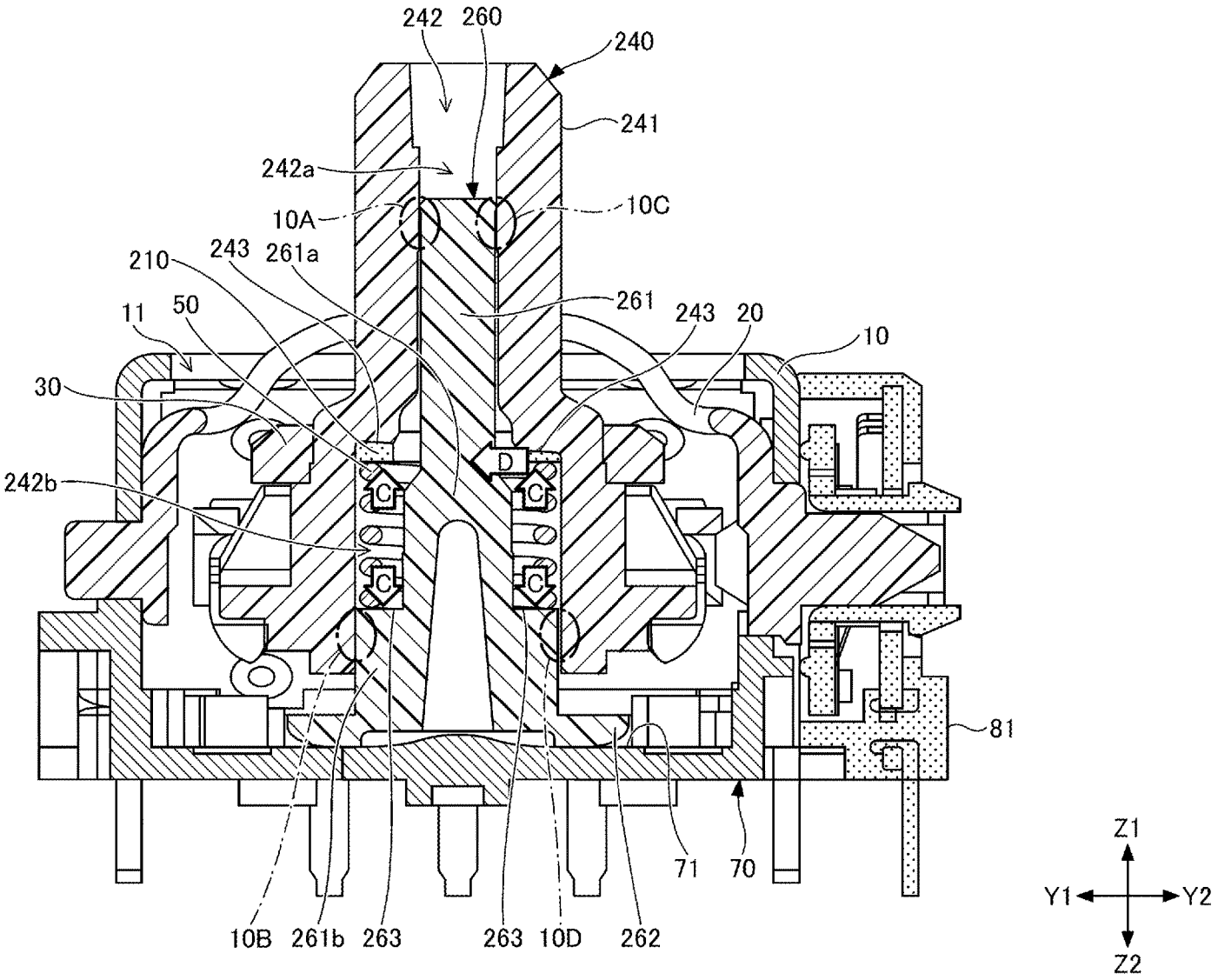
FIG. 10 is a cross-sectional view of the operation device according to the second embodiment.

Next, an operation device according to a second embodiment will be described with reference to FIGS. 9 and 10. The appearance and the functions of the operation device according to the present embodiment are the same as those in the first embodiment. Note that FIG. 9 is an exploded perspective view of the operation device according to the present embodiment; and FIG. 10 is a cross-sectional view parallel to the YZ plane.

The operation device according to the present embodiment includes an upper case 10, a first actuator 20, a second actuator 30, a lever 240, a spacer 210, a coil spring 50, a third actuator 260, a lower case 70, a first rotational variable resistor 81, a second rotational variable resistor 82, a push switch 83, and the like.

The lever 240 is formed to be longer in the Z1-Z2 direction, and has an operational part 241 on the Z1 side, and an opening 242 formed to have a cylindrical shape. The width of the opening 242 is formed to be narrower at an upper opening 242*a* on the Z1 side, and to be wider at a lower opening 242*b* on the Z2 side, and between the upper opening 242*a* and the lower opening 242*b* on the Z2 side at which the width of the opening 242 changes, a step 243 is formed. The surface of the step 243 is inclined with respect to the XY plane, and the Y2 side is lower than the Y1 side. The tilt angle of the surface of the step 243 with respect to the XY plane is, for example, 7 degrees.

The third actuator 260 is formed to be longer in the Z1-Z2 direction, and has a shaft portion 261 on the Z1 side, and a bottom 262 on the Z2 side that is virtually circular. The shaft portion 261 has a thin shaft portion 261*a* on the Z1 side and a thick shaft portion 261*b* on the Z2 side, and between the thin shaft portion 261*a* on the Z1 side and the thick shaft portion 261*b* on the Z2 side, a step 263 is formed. The surface of the step 263 is parallel to the XY plane.

The second actuator 30 is attached so as to cover a portion of the lever 240 where the width on the Z2 side is wider, and the lever 240 is contained in a through hole 31 of the second actuator 30 so as to have the operational part 241 protruded to the outside. When the operational part 241 of the lever 240 is tilted on the X1 side or on the X2 side, the lever 240 is movable within the through hole 31 of the second actuator 30.

The first actuator 20 is attached so as to cover the second actuator 30, and the lever 240 is contained in a through hole 21 of the first actuator 20 so as to have the operational part 241 protruded to the outside. When the operational part 241 of the lever 240 is tilted on the Y1 side or on the Y2 side, the lever 240 is movable within the through hole 21 of the first actuator 20.

The upper case 10 is provided to cover the first actuator 20, the second actuator 30, the third actuator 260, and a portion of the lever 240 on the Z2 side, which are above the lower case 70, and from the through hole 11 of the upper case 10, the operational part 241 of the lever 240 is exposed.

When the lever 240 is pushed in the Z2 direction, the second actuator 30 moves in the Z2 direction together with the lever 240; a shaft portion 33 provided in the second actuator 30 pushed a pushdown part 83*a* of a push switch 83; and thereby, the push switch 83 can be turned on.

In this state, the coil spring 50 contracts in the Z1-Z2 direction, and a restoring force is generated in the direction extending in the Z1-Z2 direction. Therefore, once the operator detaches the lever 240, the force pushing the lever 240 in the Z2 direction disappears; therefore, the restoring force generated in the coil spring 50 pushes the lever 240 up in the Z1 direction, and thereby, the lever 140 can be returned to the original state.

Note that also in the case where the operational part 241 of the lever 240 is tilted in the X1 direction, the X2 direction, the Y1 direction, or the Y2 direction, the coil spring 50 contracts, and hence, by detaching the operational part 241 of the lever 240, the restoring force of the coil spring 50 causes the lever 140 to return to the original state.

Figure 11:
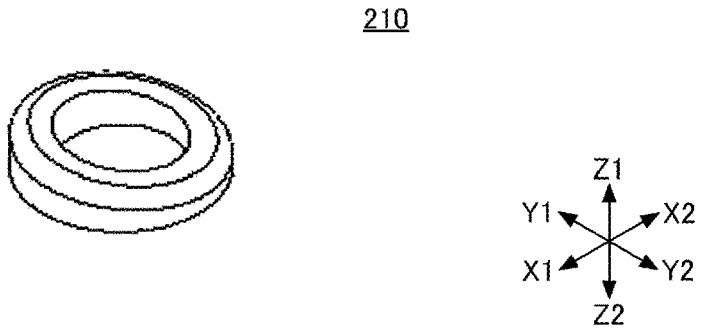
FIG. 11 is a perspective view of a spacer according to the second embodiment.

As illustrated in FIG. 11, the spacer 210 is a ring-shaped member, and is inclined such that the Y1 side is thicker than the Y2 side.

As illustrated in FIG. 10, the operation device according to the present embodiment has the bottom 262 of the third actuator 260 installed on the bottom portion 71 on the Z1 side of the lower case 70. The shaft portion 261 of the third actuator 260 is contained inside the opening 242 of the lever 240. On the step 263 of the shaft portion 261 of the third actuator 260, the coil spring 50 is installed, and an end of the step 263 of the third actuator 260 contacts the Z2 side of the coil spring 50. Also, the spacer 210 is placed on an end of the coil spring 50 on the Z1 side; another end of the coil spring 50 on the Z1 side contacts a surface of the spacer 210 on the Z2 side; and further, a surface of the ring-shaped spacer 210 on the Z1 side contacts the step 243 in the opening 242 of the lever 240. Therefore, the coil spring 50 is installed between the step 263 of the third actuator 260 and the spacer 210, inside the opening 242 of the lever 240.

Figure 12:
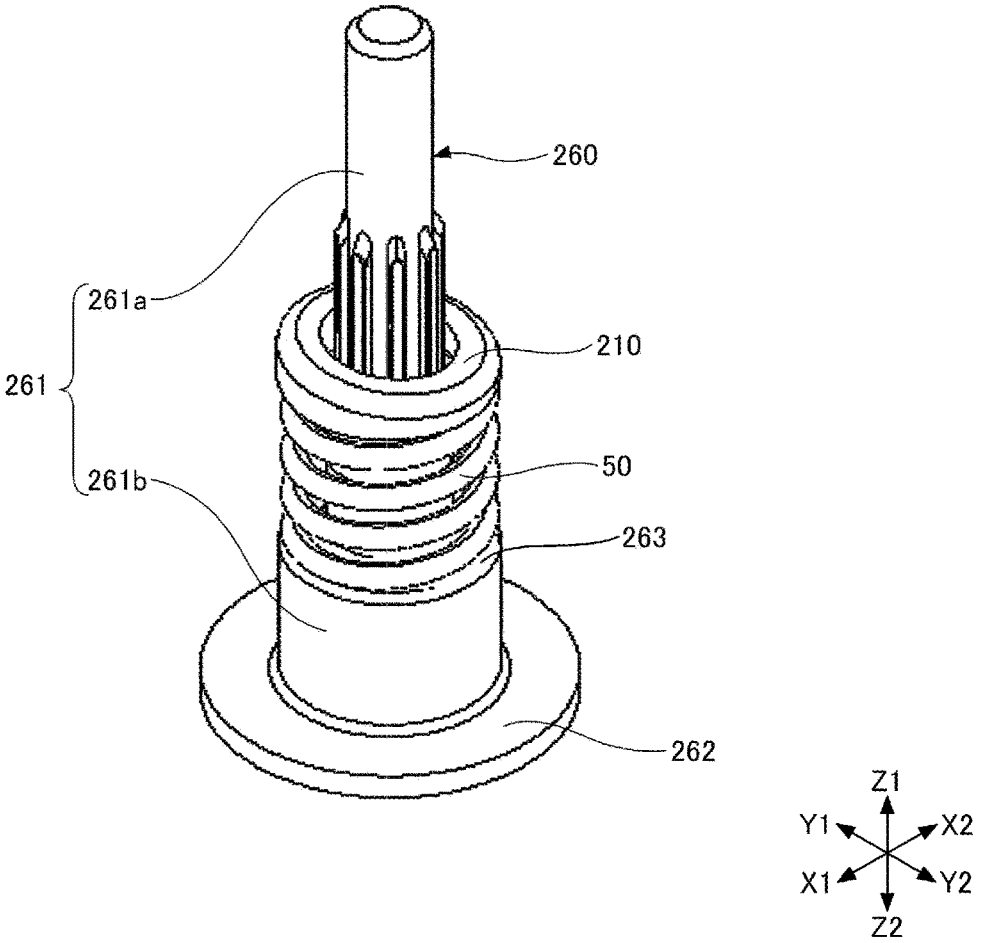
FIG. 12 is explanatory diagram of the operation device according to the second embodiment.

FIG. 12 illustrates a relationship among the third actuator 260, the spacer 210, and the coil spring 50, in which the coil spring 50 is installed on the step 263 of the third actuator 260, and the spacer 210 is installed on the coil spring 50. The spacer 210 has a slope corresponding to the slope of the step 243 of the opening 242 of the lever 240.

As illustrated in FIG. 10, the step 263 of the shaft portion 261 of the third actuator 260 is formed to be substantially parallel to the XY plane. Also, although the step 243 in the opening 242 of the lever 240 is inclined with respect to the XY plane, the surface of the spacer 210 on the Z2 side below the step 243 is substantially parallel to the XY plane.

In the state illustrated in FIG. 10, the coil spring 50 contracts, and as designated with arrows C, a restoring force extending in the Z1-Z2 direction is generated. Therefore, the spacer 210 pushed in the Z1 direction by the coil spring 50 moves to the Y1 side as if sliding on the inclined surface of the step 243. By the spacer 210 moved in this way, the shaft portion 261 of the third actuator 260 is pushed in the Y1 direction as designated with an arrow D, and at portions of the shaft portion 261 of the third actuator 260 on the Y1 side designated with one dot chain lines 10A and 10B, the opening 242 of the lever 240 comes into contact the shaft portion 261 of the third actuator 260. Therefore, the looseness and the play are almost eliminated, and thereby, the reaction upon operating the operational part 241 of the lever 240 can be accelerated.

Note that at portions designated with one dot chain lines 10C and 10D on the Y2 side, gaps are generated between the opening 242 of the lever 240 and the shaft portion 261 of the third actuator 260. However, thanks to the restoring force by the coil spring 50, on the Y1 side of the shaft portion 261 of the third actuator 260, the state of the opening 242 of the lever 240 contacting the shaft portion 261 of the third actuator 260 is maintained; therefore, even if the operational part 241 of the lever 240 is operated, no delay would be generated in the reaction due to the operation of the operational part 241 of the lever 240.

Note that the contents other than those described above are substantially the same as according to the first embodiment.

Third Embodiment

Next, an operation device according to a third embodiment will be described with reference to FIGS. 13 and 14.

The appearance and the functions of the operation device according to the present embodiment are the same as those in the second embodiment.

Figure 13:
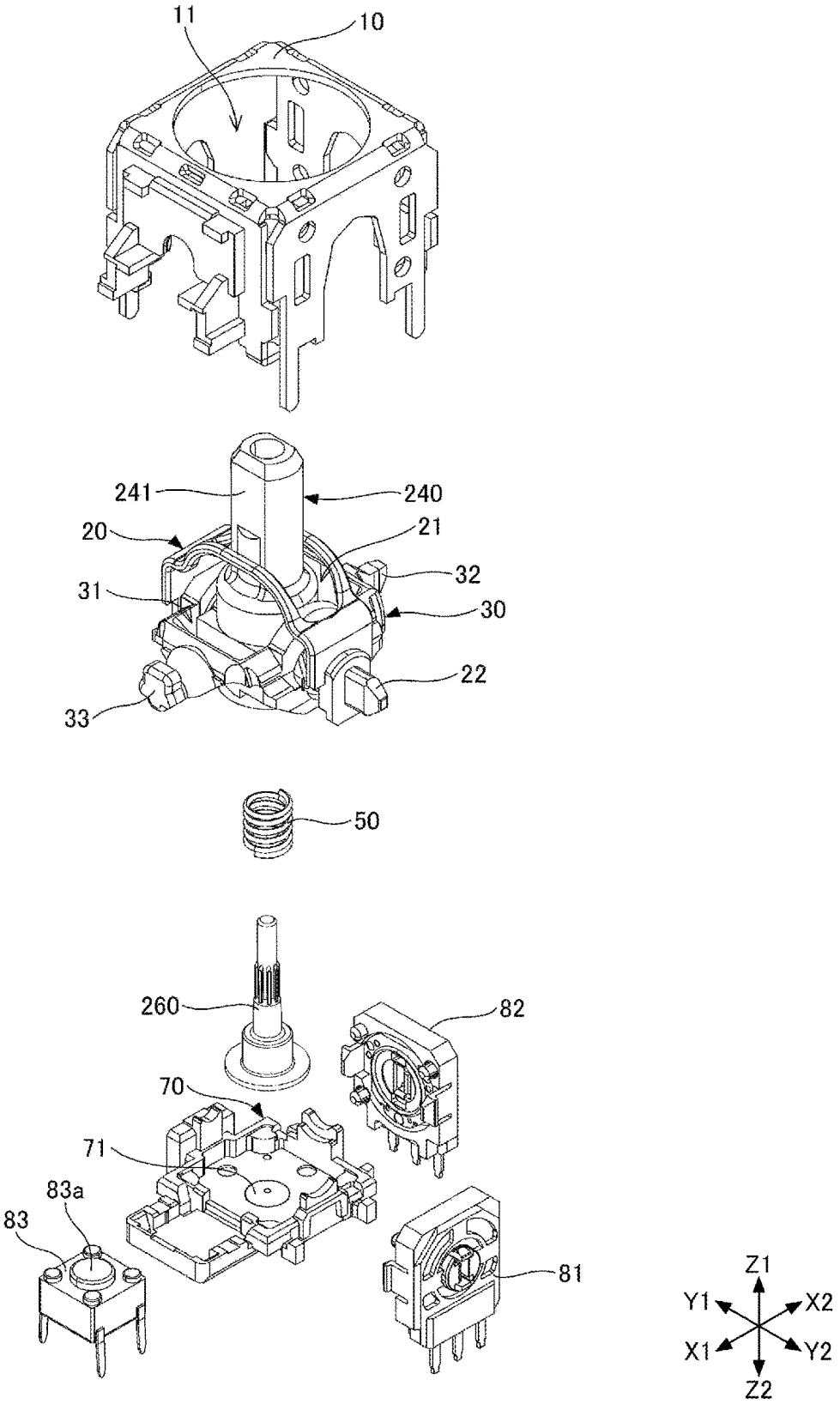
FIG. 13 is an exploded perspective view of an operation device according to a third embodiment.

As illustrated in FIG. 13, the operation device according to the present embodiment includes an upper case 10, a first actuator 20, a second actuator 30, a lever 240, a coil spring 50, a third actuator 260, a lower case 70, a first rotational variable resistor 81, a second rotational variable resistor 82, a push switch 83, and the like. Thus, the operation device according to the present embodiment has a structure such that the spacer 210 is not provided in the second embodiment.

Figure 14:
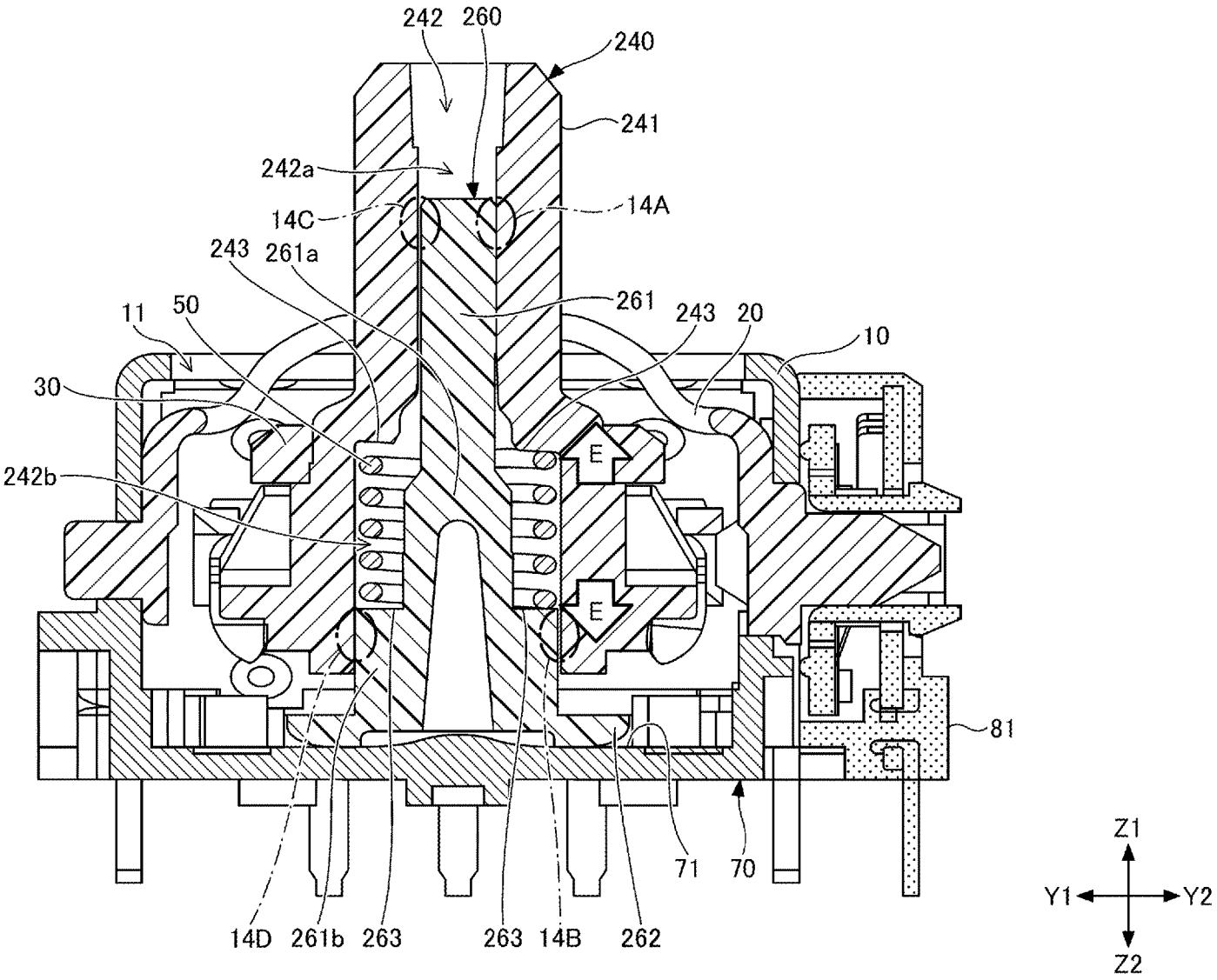
FIG. 14 is a cross-sectional view of the operation device according to the third embodiment.

As illustrated in FIG. 14, the operation device according to the present embodiment has a bottom 262 of the third actuator 260 installed on a bottom portion 71 on the Z1 side of the lower case 70. A shaft portion 261 of the third actuator 260 is contained inside the opening 242 of the lever 240. The coil spring 50 is provided inside an opening 242 of the lever 240, to be installed between a step 263 of the shaft portion 261 of the third actuator 260 and a step 243 in the opening 242 of the lever 240; an end of the coil spring 50 on the Z1 side contacts the step 243 of the lever 240; and another end of the coil spring 50 on the Z2 side contacts the step 263 of the third actuator 260.

As illustrated in FIG. 14, although the step 263 of the shaft portion 261 of the third actuator 260 is formed to be substantially parallel to the XY plane, the step 243 in the opening 242 of the lever 240 is inclined with respect to the XY plane.

In the state illustrated in FIG. 14, the coil spring 50 contracts, and as designated with arrows E, a restoring force extending in the Z1-Z2 direction is generated. This restoring force is stronger on the Y2 side at which the width is narrower than on the Y1 side at which the width between the step 243 of the lever 240 and the step 263 of the third actuator 260 is wider. Therefore, on the Y2 side, the restoring force of the coil spring 50 acts strongly in a direction of separating the step 243 of the opening 242 of the lever 240 away from the step 263 of the third actuator 260. Therefore, the vicinity of an end of the shaft portion 261 on the Z1 side of the third actuator 260 designated with a one dot chain line 14A comes into contact with the inside of the opening 242 of the lever 240, and the inside of the vicinity of another end of the shaft portion 261 on the Z2 side of the third actuator 260 designated with a one dot chain line 14D comes into contact with the shaft portion 261 of the third actuator 260. Therefore, the looseness and the play are almost eliminated, and thereby, the reaction upon operating the operational part 241 of the lever 240 can be accelerated.

Note that in the shaft portion 261 of the third actuator 260, at portions designated with one dot chain lines 14B and 14C, gaps are generated between the opening 242 of the lever 240 and the shaft portion 261 of the third actuator 260. However, thanks to the restoring force by the coil spring 50, at portions designated with the one dot chain lines 14A and 14D, the state of the opening 242 of the lever 240 contacting the shaft portion 261 of the third actuator 260 is maintained; therefore, even if the operational part 241 of the lever 240 is operated, no delay would be generated in the reaction due to the operation of the operational part 241 of the lever 240.

Note that that the contents other than those described above are substantially the same as according to the second embodiment.

As above, the embodiments of the present inventive concept have been described in detail; it should be noted that the various modifications and alterations can be made within the scope of the present inventive concept described in the claims.

What is claimed is:

1. An operation device comprising:

a housing provided with a through hole;

a cylinder-shaped lever inserted into the housing through the through hole of the housing, that can be operated to be tilted;

an actuator contained in a cylinder-shaped opening of the lever; and an elastic member provided between the actuator and the lever, wherein a step is provided in the opening of the lever on one side of the elastic member, wherein a step is provided in the actuator on another side of the elastic member, and wherein a surface of the step of the actuator is inclined with respect to a surface of the step in the opening of the lever.

2. The operation device as claimed in claim 1, further comprising:

a spacer provided so as to be in contact with the step of the actuator, wherein a surface of the step of the actuator is inclined, wherein the spacer has a slope corresponding to the surface of the step of the actuator, wherein one end of the elastic member contacts the step provided in the opening of the lever, and wherein another end of the elastic member contacts the spacer.

3. The operation device as claimed in claim 1, further comprising:

a spacer provided so as to be in contact with the step of the opening of the lever, wherein a surface of the step of the opening of the lever is inclined, wherein the spacer has a slope corresponding to the surface of the step of the opening of the lever, wherein one end of the elastic member contacts the spacer, and wherein another end of the elastic member contacts the step provided in the actuator.

4. The operation device as claimed in claim 1, wherein one end of the elastic member contacts the step provided in the lever, and wherein another end of the elastic member contacts the step provided in the actuator.

5. The operation device as claimed in claim 2, wherein the spacer pushing the lever or the actuator by a restoring force of the elastic member, causes the lever to come into contact with the actuator, inside the opening of the lever.

6. The operation device as claimed in claim 4, wherein a restoring force of the elastic member acts in a direction of separating the step of the actuator away from the step of the opening of the lever, and causes the lever to come into contact with the actuator, inside the opening of the lever.

7. The operation device as claimed in claim 1, wherein the actuator is a third actuator, wherein the operation device further includes a first actuator configured to rotate in response to the lever being tilted in a first direction, and a second actuator configured to rotate in response to the lever being tilted in a second direction orthogonal to the first direction, wherein by pushing down the lever, the lever moves in a third direction orthogonal to the first direction and to the second direction, and wherein the second actuator moves in the third direction as the lever moves.

* * * * *